US007264319B2

(12) United States Patent
Cheng

(10) Patent No.: US 7,264,319 B2
(45) Date of Patent: Sep. 4, 2007

(54) DRAWER LOCKING APPARATUS OF A CABINET

(75) Inventor: Chen Kung Cheng, Taichung Hsien (TW)

(73) Assignee: E-Make Co., Ltd., Taichung Hsien (TW)

( * ) Notice: Subject to any disclaimer, the term of this patent is extended or adjusted under 35 U.S.C. 154(b) by 204 days.

(21) Appl. No.: 11/014,178

(22) Filed: Dec. 17, 2004

(65) Prior Publication Data

US 2006/0132005 A1 Jun. 22, 2006

(51) Int. Cl.
*E05C 7/06* (2006.01)

(52) U.S. Cl. ..... 312/220; 312/216; 312/217

(58) Field of Classification Search ..... 312/216, 312/217, 218, 220, 221, 107.5, 222, 215, 312/290, 310, 312; 292/DIG. 18; 70/78, 70/85

See application file for complete search history.

(56) References Cited

U.S. PATENT DOCUMENTS

| | | | | |
|---|---|---|---|---|
| 106,970 | A * | 8/1870 | Titus | 312/220 |
| 170,145 | A * | 11/1875 | Williams | 312/221 |
| 505,799 | A * | 9/1893 | Brown | 312/220 |
| 6,347,848 | B1 * | 2/2002 | Cho | 312/219 |
| 6,572,203 | B1 * | 6/2003 | Cheng | 312/217 |

* cited by examiner

*Primary Examiner*—James O. Hansen
*Assistant Examiner*—Philip Gabler
(74) *Attorney, Agent, or Firm*—Troxell Law Office, PLLC

(57) ABSTRACT

A drawer locking apparatus of a cabinet, including a cabinet body, at least one drawer slidably disposed in the cabinet body, a base seat mounted in the cabinet body, a slide section slidably fitted in the base seat, an engaging section and a dogging device. One end of the engaging section is disposed on the slide section. The other end of the engaging section has a hook plate with a guide slope for hooking rear sideboard of the drawer. The dogging device serves to drive the slide section to slide between a first position and a second position.

1 Claim, 10 Drawing Sheets

DRAWER LOCKING APPARATUS OF A CABINET

BACKGROUND OF THE INVENTION

The present invention is related to a drawer locking apparatus, and more particularly to a drawer locking apparatus of a file cabinet or a tool cabinet.

A conventional file or tool cabinet is a substantially rectangular case body with six faces. The case body is formed by several panels defining a space therebetween. Several drawers are horizontally disposed in the space layer by layer for placing documents or tools therein. In order to prevent the documents or tools from being stolen or prevent the drawers from dropping out due to shock or inclination of the ground, the file or tool cabinet is equipped with a locking device for locking the drawers.

In order to lock the respective drawers at one time, a conventional device or such as U.S. Pat. No. 4,966,422 disclose a locking device including an up and down movable latch body disposed on the panels of the case body. Each drawer has a hook section corresponding to a latch hole or a latch section of the latch body. The latch body is drivingly connected with a link. One end of the link extends out of the case body to connect with a rotary mechanism such as a key unit. By means of turning the rotary mechanism, the link is driven to drive the latch body to reciprocally move. Accordingly, the hook section can be latched with the latch hole or latch section to lock the respective drawers at one time.

When locking the drawers, the drawers must be totally pushed into the case body so as to locate the hook section at a position where the hook section is latched with the latch hole or latch section. However, it often takes place that after locking the drawers, a user finds that one or some of the drawers are not totally pushed in and are not locked. Under such circumstance, the user must unlock the drawers and then totally push in the drawers and then again lock the drawers. This makes it inconvenient and troublesome to perform the locking operation for the drawers.

The above shortcomings have been overcome by U.S. Pat. No. 6,347,848 and U.S. Pat. No. 6,572,203. These Patents include a latch body upper end of which are formed with a slot having a predetermined length, a link having a bending section and a latch plate disposed on the drawer and having an inclined stop section. In the case that the latch body is positioned in a locking position for locking the drawers, while some drawers are not totally pushed in and locked, a user only needs to further force and push in the drawers. At this time, the latch body will ascend and then fall down to lock all the drawers.

In the structures of the above two U.S. Patents, the latch body is formed with several openings and each drawer is equipped with a latch plate. The cost for manufacturing time and labor and the cost for the material of such structure are relatively high.

SUMMARY OF THE INVENTION

It is therefore a primary object of the present invention to provide a drawer locking apparatus of a cabinet. The drawing locking apparatus includes simpler components which can be more easily assembled. The cost for the materials of these components is lower. After the locking apparatus is locked, in the case that some other drawers are not locked, all the drawers can be easily and conveniently locked.

According to the above object, the drawer locking apparatus of the cabinet of the present invention includes a cabinet body, at least one drawer slidably disposed in the cabinet body, a base seat mounted in the cabinet body, a slide section slidably fitted in the base seat, an engaging section and a dogging device. One end of the engaging section is disposed on the slide section. The other end of the second engaging section has a hook plate with a guide slope. The dogging device includes a force application section, a transmission section, a first coupling section and a second coupling section.

The present invention can be best understood through the following description and accompanying drawings wherein:

DETAILED DESCRIPTION OF THE PREFERRED EMBODIMENTS

Figure 1:
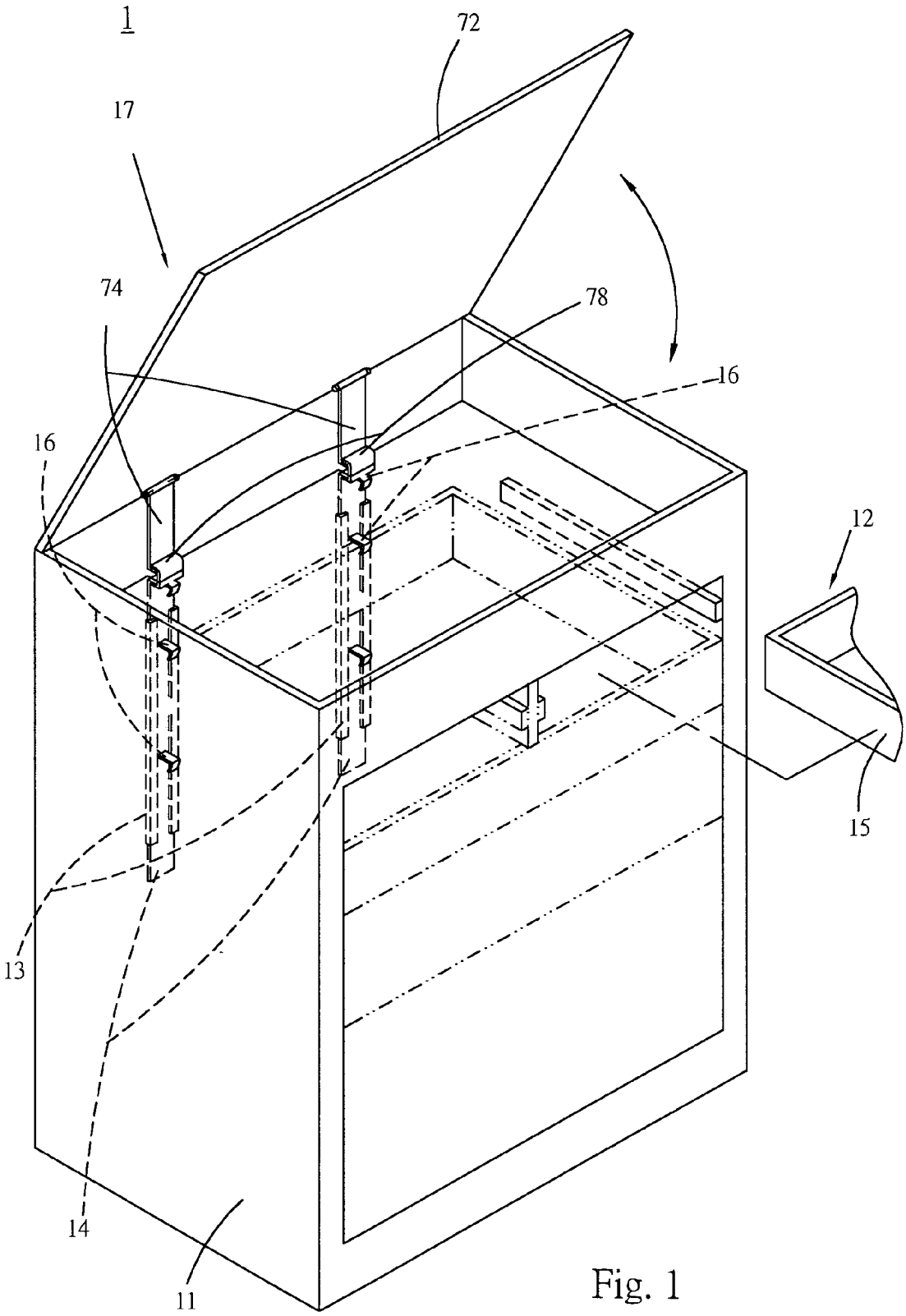
FIG. 1 is a perspective partially exploded view of a first embodiment of the present invention.
Figure 2:
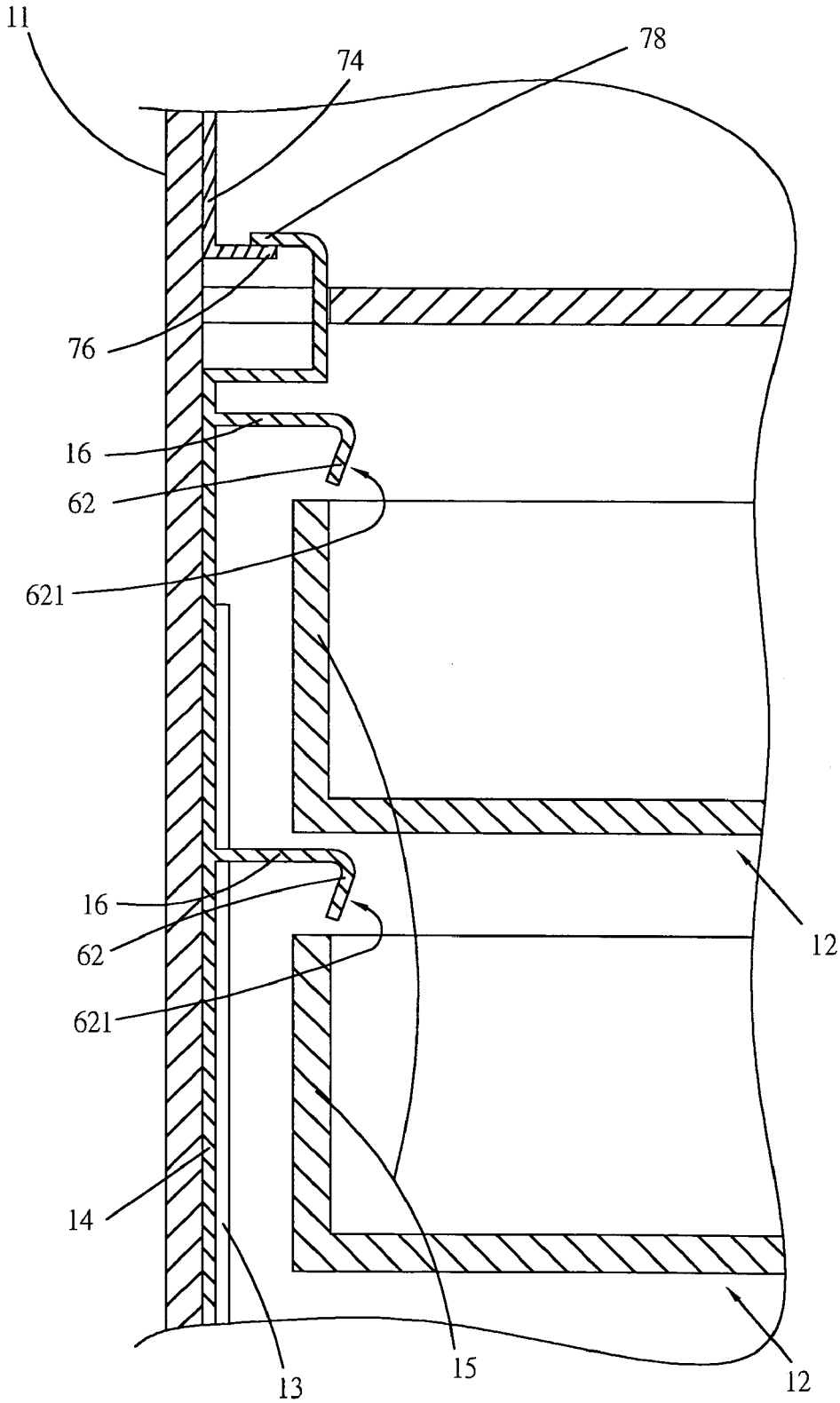
FIG. 2 is a sectional view showing that the first embodiment of the present invention is in an unlocked state (in which the slide section is positioned in the first position)
Figure 3:
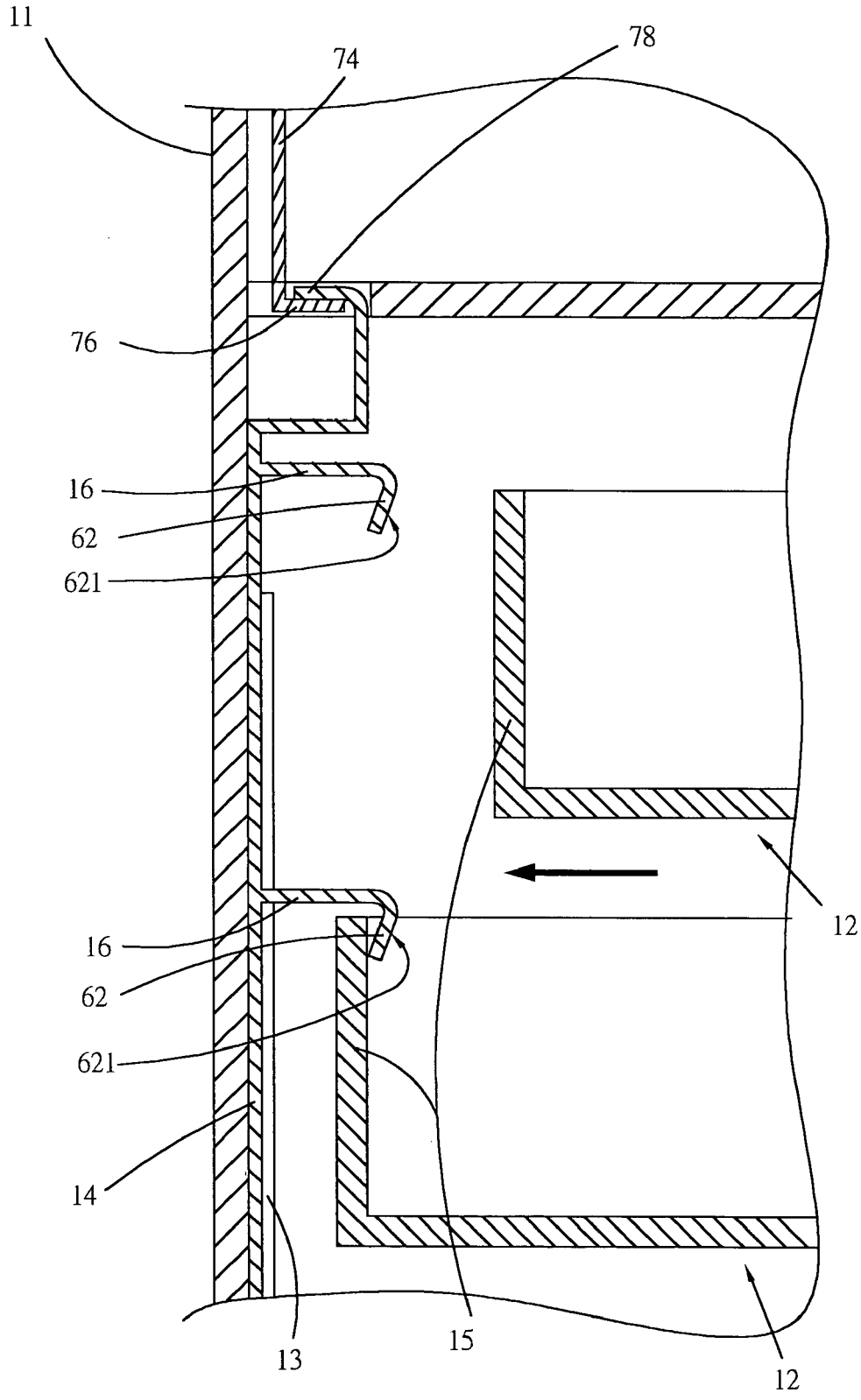
FIGS. 3 to 5 are sectional views showing that the first embodiment of the present invention is in a locked state (in which the slide section positioned in the second position), wherein one drawer is inward pushed.
Figure 4:
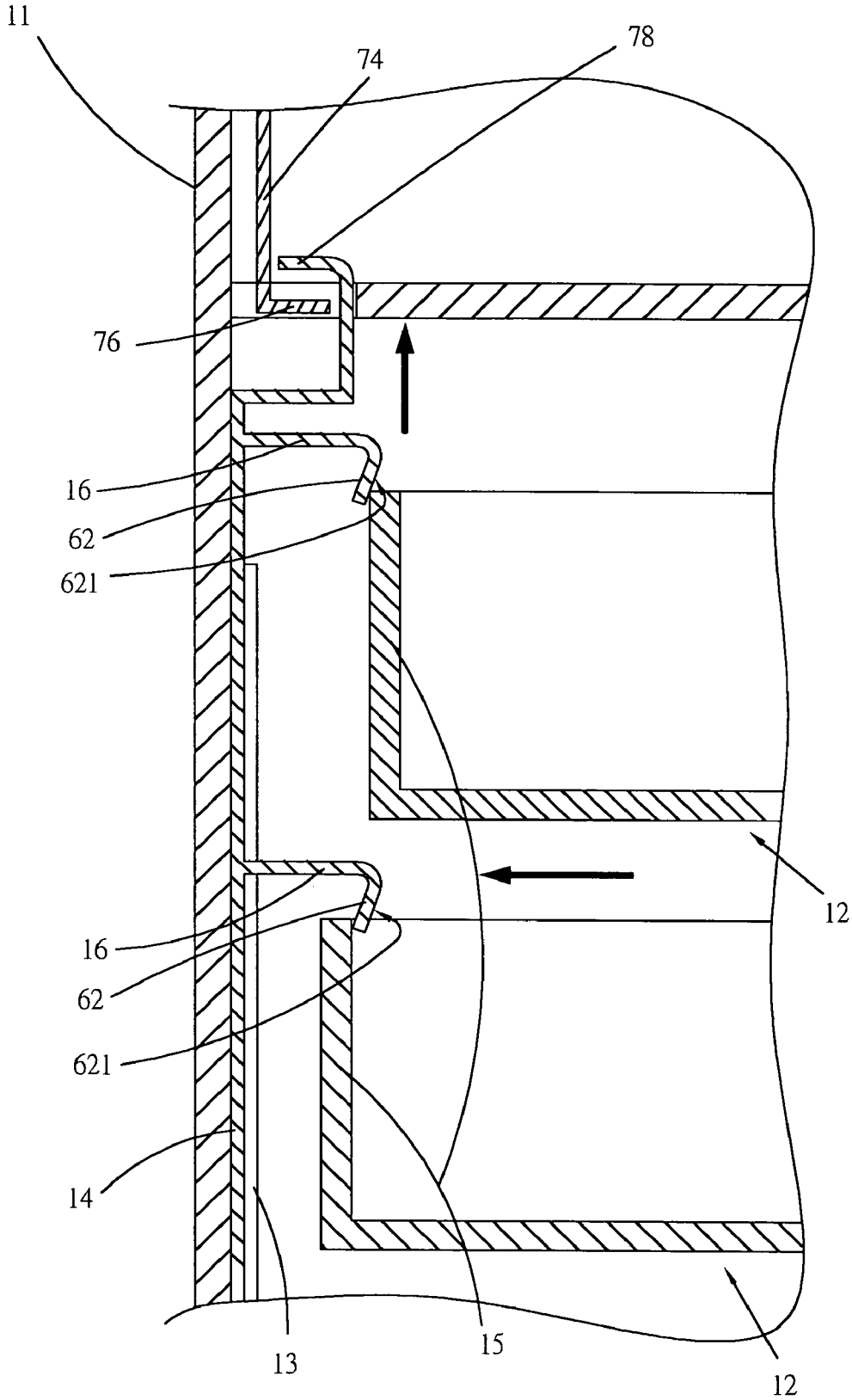
Figure 5:
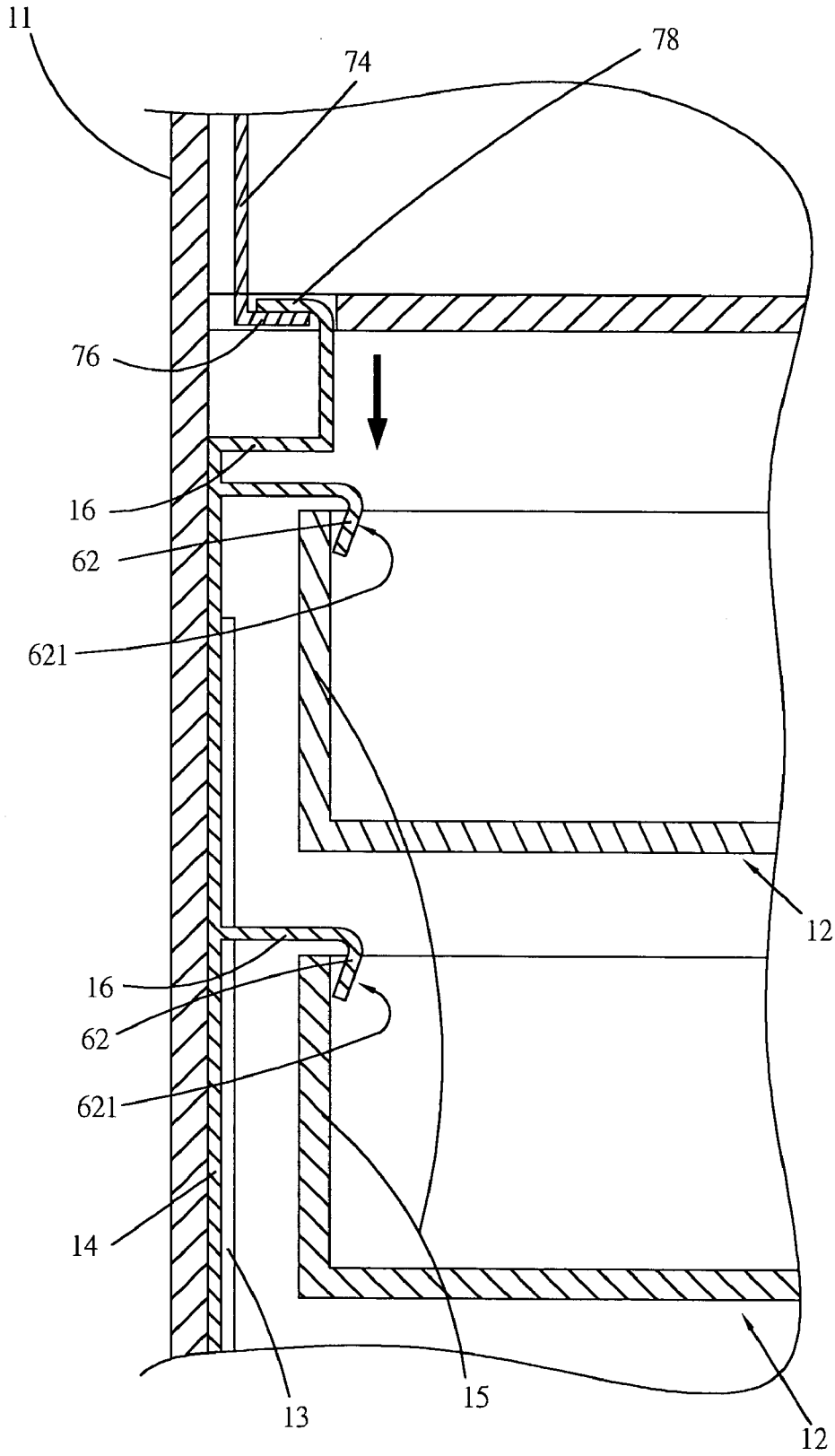
Figure 6:
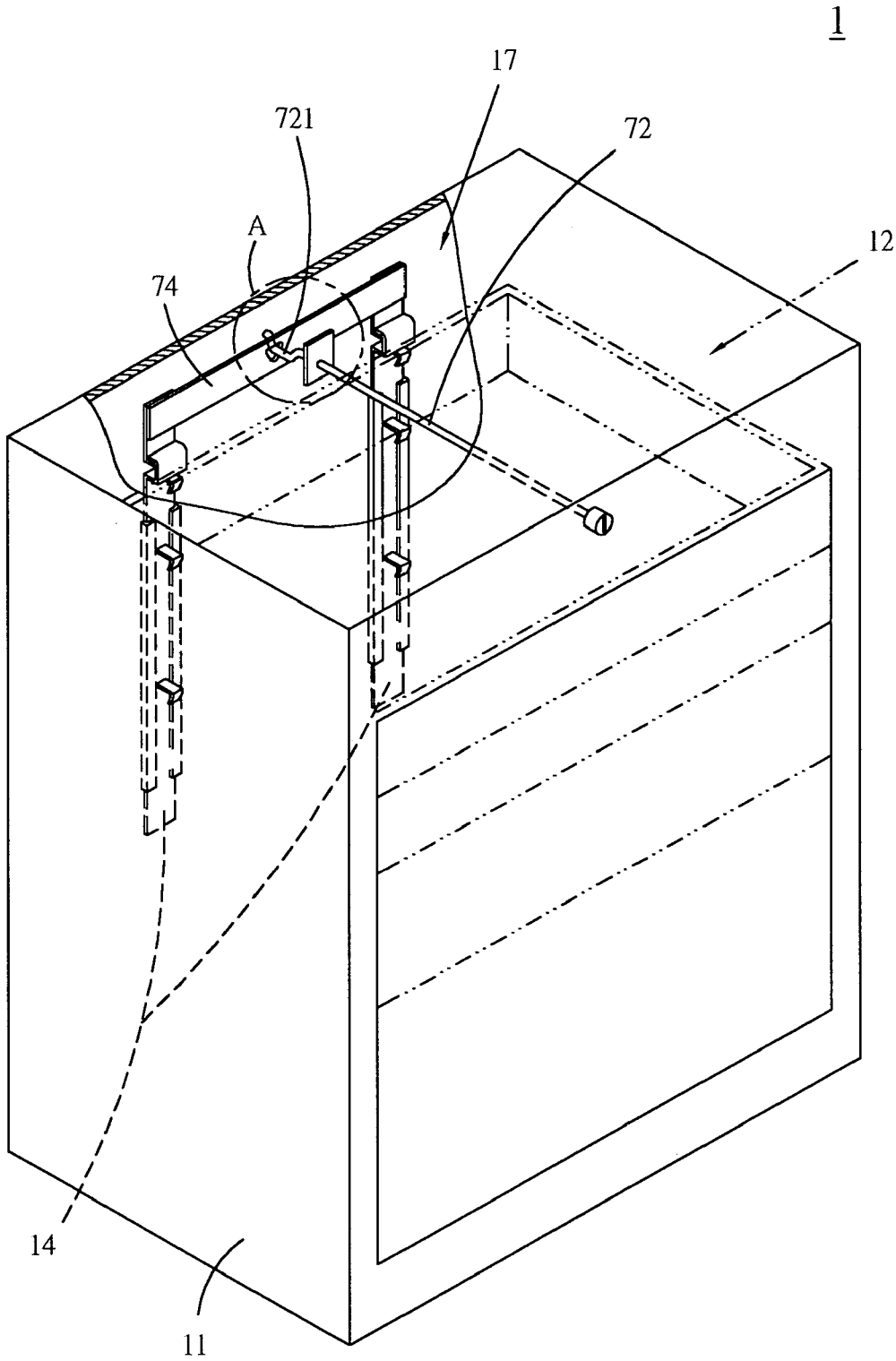
FIG. 6 is a perspective exploded view of a second embodiment of the present invention.
Figure 6A:
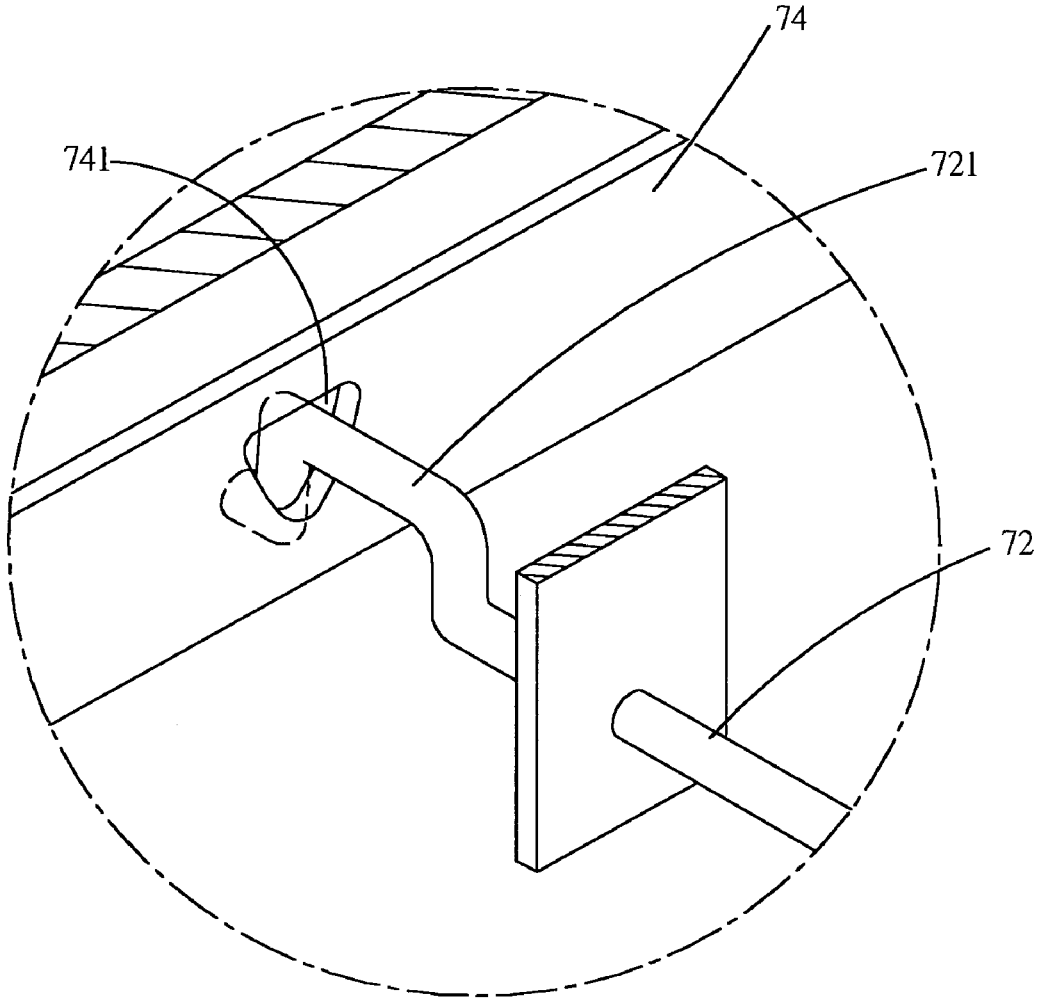
FIG. 6A is an enlarged view of circled area A of FIG. 6.
Figure 7:
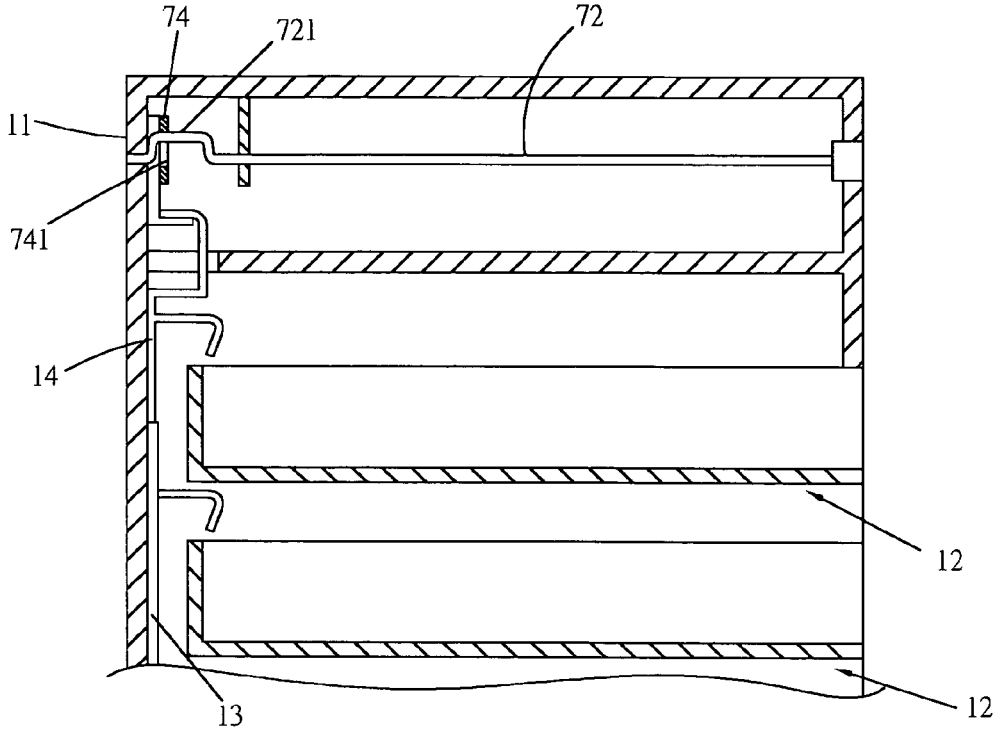
FIG. 7 is a sectional view showing that the second embodiment of the present invention is in an unlocked state (in which the slide section is positioned in the first position)
Figure 8:
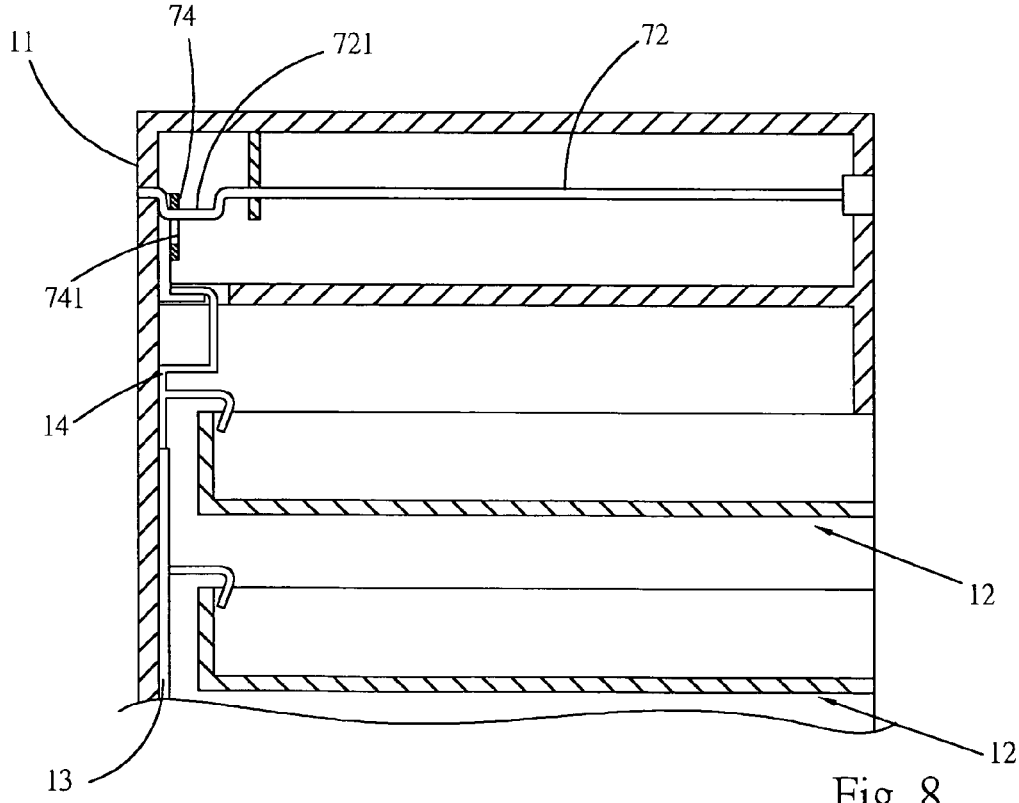
FIG. 8 is a sectional view showing that the second embodiment of the present invention is in a locked state (in which the slide section positioned in the second position)

Please refer to FIGS. 1 to 5. The drawer locking apparatus 1 of the cabinet of the present invention includes a cabinet body 11, at least one drawer 12 disposed in the cabinet body 11, a base seat 13 disposed in the cabinet body 11, a slide section 14 slidably fitted in the base seat 13, a first engaging section 15, a second engaging section 16 and a dogging device 17.

The cabinet body 11 is a solid body composed of five rectangular panels defining an internal space and a vertical open face. The drawer 12 is back and forth slidably disposed in the open face. The drawer 12 is composed of five rectangular panels defining an opening facing upward.

The base seat 13 is mounted on inner side of rear panel of the cabinet body 11 corresponding to rear side of the drawer 12.

The slide section 14 is vertically slidably fitted in the base seat 13 and slidable between a first position and a second position.

The first engaging section 15 is disposed on the drawer 12. For example, the first engaging section 15 can be the rear sideboard of the drawer 12.

One end of the second engaging section 16 is disposed on the slide section 14 corresponding to the first engaging section 15. The other end of the second engaging section 16 has a hook plate 62 obliquely extending toward the rear panel of the cabinet body 11 by a certain length. The hook plate 62 has a guide slope 621. When the slide section 14 is positioned in the first position, the hook plate 62 will not hinder the first engaging section 15 from passing through the hook plate 62, whereby the drawer 12 can be freely back and forth slid. When the slide section 14 is positioned in the second position, the hook plate 62 is engaged with the first engaging section 15, whereby the drawer 12 cannot be drawn out of the cabinet body 11.

The dogging device 17 includes a force application section 72, a transmission section 74, a first coupling section 76 and a second coupling section 78.

The transmission section 74 is disposed between the slide section 14 and the force application section 72. The force application section 72 serves to drive the transmission section 74 to reciprocally move. In this embodiment, the force application section 72 is a cover board one side of which is pivotally connected with one side of the panel of the cabinet body 11, on which the base seat 13 is mounted. The cover board is positioned on upper side of the cabinet body 11 and also pivotally connected with the transmission section 74. When a user opens or closes the cover board, the transmission section 74 is driven to reciprocally move.

The first coupling section 76 is disposed on the transmission section 74 and transversely extends from one end of the transmission section 74 by a certain length.

The second coupling section 78 is disposed on the slide section 14 for coupling with the first coupling section 76. The transmission section 74 can drive the slide section 14 to slide between the first and second positions. When the slide section 14 is positioned in the second position, the first engaging section 15 can inward push the hook plate 62 to drive the slide section 14 to move to the first position. At this time, the first engaging section 15 can pass over the hook plate 62. Then the slide section 14 is restored to the second position. One end of the slide section 14 winds to form a channeled body as the second coupling section 78. The channeled body has a bottom side and two lateral sides. One of the lateral sides of the second coupling section 78 abuts against the first coupling section 76.

According to the above arrangement, the drawer locking apparatus 1 of the cabinet of the present invention has the following advantages:

1. The hook plate 62 can directly hook the rear sideboard of the drawer 12. Therefore, the cost for the material is saved and the assembling time is shortened.
2. The first and second coupling sections 76, 78 are bent to connect with each other in a hanging manner. Therefore, the assembling procedure is simplified so that the assembling time and labor are saved.

Referring to FIGS. 6 to 8 and FIG. 6A, according to a second embodiment, the force application section 72 is a rod body with a certain length. The rod body passes through the transmission section 74. One end of the rod body is pivotally connected with the rear panel of the cabinet body 11 corresponding to rear side of the drawer 12. The other end of the rod body is pivotally connected with the cabinet body 11 corresponding to front side of the drawer 12 and exposed to outer side of the cabinet body 11. The other end of the rod body is equipped with a key-driven unit. The rod body has a bent section 721 for abutting against the transmission section 74. The two end points of the rod body and the contact point of the rod body in contact with the transmission section 74 are not collinear. By means of turning the key-driven unit, the transmission section 74 can be driven to drive the slide section 14 to slide between the first and second positions.

The transmission section 74 is formed with a polygonal hole 741 such as a triangular hole through which the rod body passes. When the slide section 14 is positioned in the second position (locked state), the slide section 14 can be driven by the first engaging section 15 to move to the first position and then restore to the second position.

Figure 9:
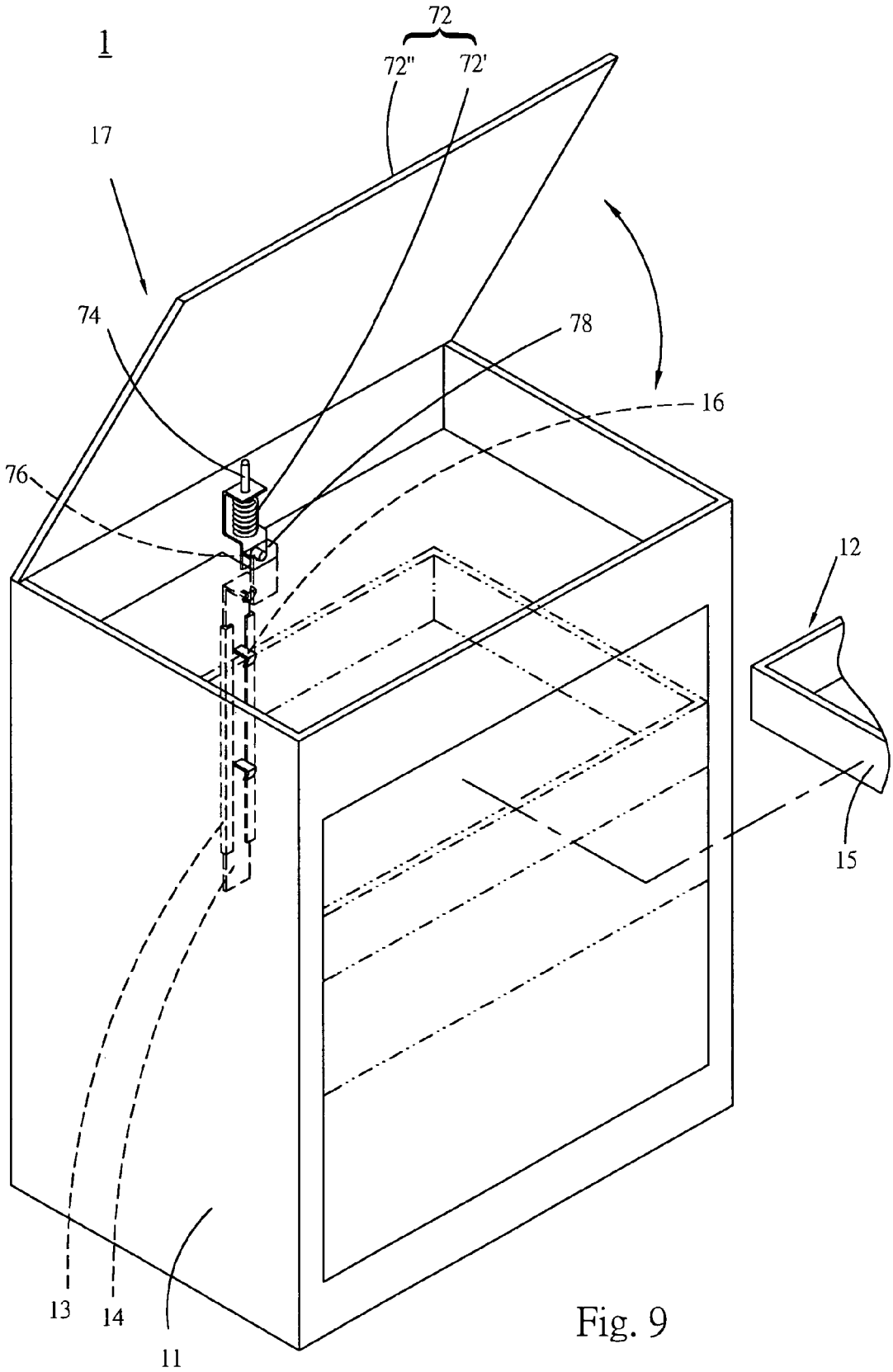
FIG. 9 is a perspective view of a third embodiment of the present invention.
Figure 10:
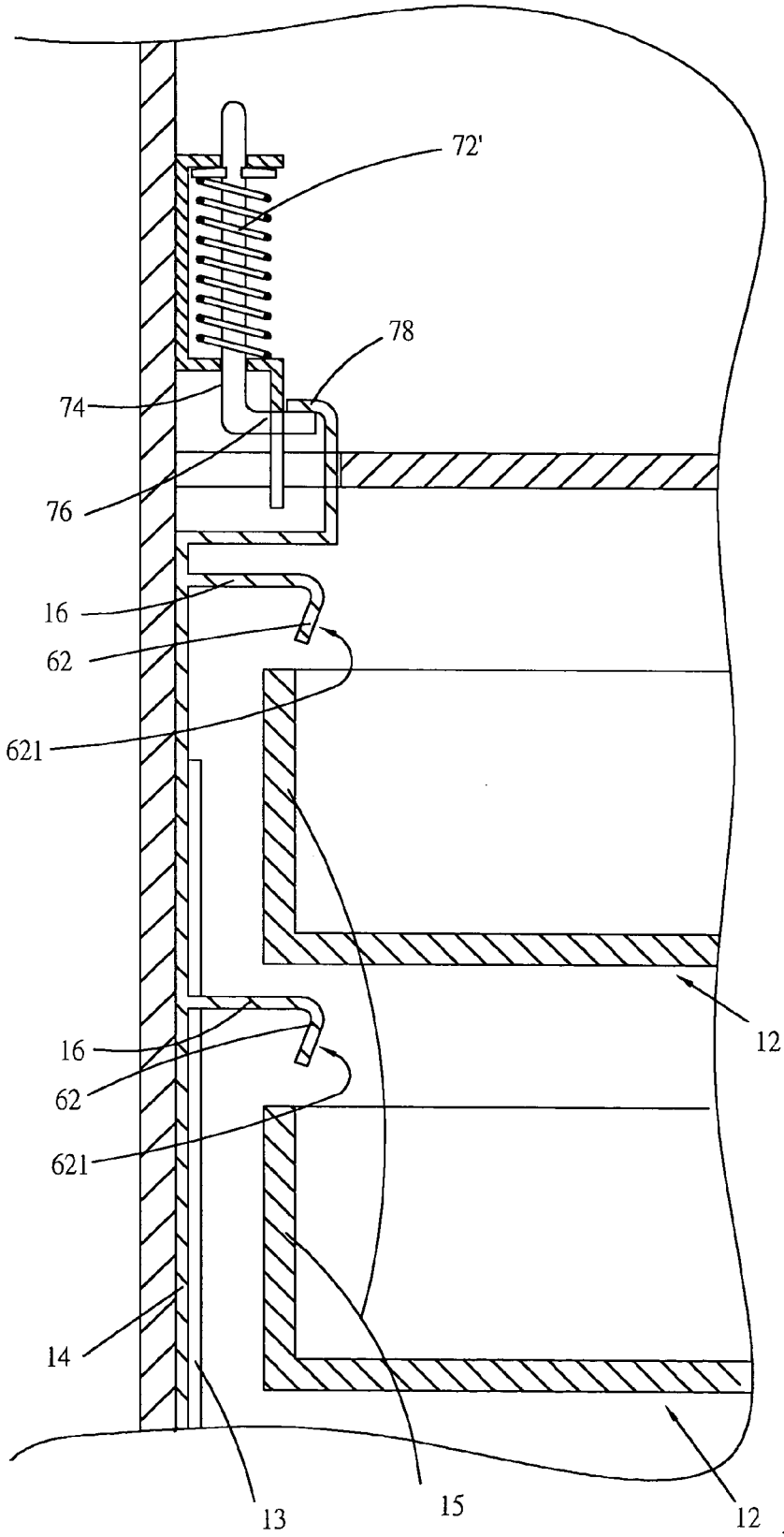
FIG. 10 is a sectional view showing that the third embodiment of the present invention is in an unlocked state (in which the slide section is positioned in the first position).

FIGS. 9 and 10 show a third embodiment of the present invention, in which the force application section 72 includes a resilient member 72' and a cover board 72". The resilient member 72' can be a coiled spring disposed at the middle of the transmission section 74 for driving the same.

One side of the cover board 72" is pivotally connected with one side of the panel of the cabinet body 11, on which the base seat 13 is mounted. The cover board 72" is positioned on upper side of the cabinet body 11 to abut against upper end of the transmission section 74 or release the upper end of the transmission section 74. When the cover board 72" is pivoted up and opened, the transmission section 74 is released from the abutting force of the cover board 72". The resilient member 72' pushes the transmission section 74 to move upward or the resilient member 72' pushes the transmission section 74 to move upward and still abut against the cover board 72", whereby the slide section 14 is positioned in the first position (unlocked state). When the cover board 72" is pivoted downward and closed, the cover board 72" pushes the transmission section 74 to move downward, whereby the slide section 14 is positioned in the second position (locked state).

The above embodiments are only used to illustrate the present invention, not intended to limit the scope thereof. Many modifications of the above embodiments can be made without departing from the spirit of the present invention.

What is claimed is:

1. A drawer locking apparatus of a cabinet, comprising:

a cabinet body which is a solid body composed of five rectangular panels defining an internal space and a vertical open face, at least one drawer being back and forth slidably disposed in the open face, the drawer being composed of five rectangular panels defining an opening facing upward;

a base seat mounted on an inner side of a rear panel of the cabinet body corresponding to a rear side of the drawer;

a slide section vertically slidably fitted in the base seat and slidable between a first position and a second position;

a first engaging section being a rear sideboard of the drawer;

a second engaging section, one end of the second engaging section being disposed on the slide section corresponding to the first engaging section, the other end of the second engaging section having a hook plate with a guide slope, the hook plate obliquely extending from the second engaging section toward the rear panel of the cabinet body by a certain length, whereby when the slide section is positioned in the first position, the hook plate will not hinder the first engaging section from passing through the hook plate, whereby the drawer can be freely back and forth slid, when the slide section is positioned in the second position, the hook plate being engaged with the first engaging section, whereby the drawer cannot be drawn out of the cabinet body;

a dogging device including a force application section, a transmission section, a first coupling section and a second coupling section, the transmission section being disposed between the slide section and the force application section, the force application section serving to drive the transmission section to reciprocally move, the force application section being a cover board, one side of the cover board being pivotally connected with one side of the panel of the cabinet body on which the base seat is mounted, the cover board being positioned on upper side of the cabinet body, one end of the transmission section being pivotally connected with the cover board, whereby when the cover board is turned, the transmission section is driven by the cover board, wherein the first coupling section being disposed on the transmission section, the second coupling section being disposed on the slide section for coupling with the first coupling section, the transmission section serving to drive the slide section to slide between the first and second positions, whereby when the slide section is positioned in the second position, the first engaging section can inward push the hook plate to drive the slide section to move to the first position and the first engaging section can pass over the hook plate, then the slide section being restored to the second position, wherein the first coupling section transversely extends from another end of the transmission section by a certain length and one end of the slide section winds to form a channeled body as the second coupling section, the channeled body having a bottom side, an upward side and a top side, the top side transverse to the upward side, and both abutting against and hanging upon the first coupling section.

* * * * *